US009556872B2

(12) United States Patent
Nakazawa et al.

(10) Patent No.: US 9,556,872 B2
(45) Date of Patent: Jan. 31, 2017

(54) GAS COMPRESSOR FORMED WITH A HIGH-PRESSURE SUPPLY HOLE

(71) Applicant: Calsonic Kansei Corporation, Saitama-shi (JP)

(72) Inventors: Keisuke Nakazawa, Saitama (JP); Eiki Yanagawa, Saitama (JP)

(73) Assignee: Calsonic Kansei Corporation, Saitama-Shi (JP)

( * ) Notice: Subject to any disclaimer, the term of this patent is extended or adjusted under 35 U.S.C. 154(b) by 122 days.

(21) Appl. No.: 14/624,805

(22) Filed: Feb. 18, 2015

(65) Prior Publication Data

US 2015/0252806 A1 Sep. 10, 2015

(30) Foreign Application Priority Data

Mar. 5, 2014 (JP) ..... 2014-043193
Nov. 20, 2014 (JP) ..... 2014-235515

(51) Int. Cl.
*F03C 2/00* (2006.01)
*F03C 4/00* (2006.01)
(Continued)

(52) U.S. Cl.
CPC ..... *F04C 29/023* (2013.01); *F01C 21/0872* (2013.01); *F04C 18/321* (2013.01);
(Continued)

(58) Field of Classification Search
CPC ... F04C 23/008; F04C 18/344; F04C 18/3446; F04C 18/321; F04C 29/02; F04C 29/023; F04C 29/025; F04C 29/026; F04C 29/124; F04C 29/123; F01C 21/0809; F01C 21/0872
(Continued)

(56) References Cited

U.S. PATENT DOCUMENTS 4,795,325 A * 1/1989 Kishi ..... F04C 29/02 418/76
5,156,532 A 10/1992 Arndt et al.
(Continued)

FOREIGN PATENT DOCUMENTS

CN 1373298 A 10/2002
CN 103362806 A 10/2013
(Continued)

*Primary Examiner* — Theresa Trieu
(74) *Attorney, Agent, or Firm* — Locke Lord LLP; Howard M. Gitten

(57) ABSTRACT

A gas compressor comprises a rotor having vane grooves, a cylinder shaped to surround an outer circumference of the rotor, vanes plate-shaped, slidably inserted into the vane grooves, and abuttable at one ends on the inner circumference of the cylinder, upon receiving a back pressure from the vane grooves, two side blocks to enclose both ends of the rotor and the cylinder, respectively, compression chambers supplied with a medium to compress the medium to a high-pressure medium for discharge, an oil separator to separate, from the discharged high-pressure medium, oil to be used as the back pressure, an oil path through which the oil at a certain pressure is supplied to the vane grooves, and a high-pressure supply hole formed in at least one of the side blocks, including a small diameter portion and a large diameter portion integrally formed.

2 Claims, 5 Drawing Sheets

(51) Int. Cl.

| | |
|---|---|
| ***F04C 2/00*** | (2006.01) |
| ***F04C 29/02*** | (2006.01) |
| ***F04C 18/32*** | (2006.01) |
| ***F04C 29/12*** | (2006.01) |
| ***F01C 21/08*** | (2006.01) |
| ***F04C 18/344*** | (2006.01) |

(52) U.S. Cl.
CPC ..... *F04C 18/3446* (2013.01); *F04C 29/028* (2013.01); *F04C 29/124* (2013.01); *F04C 29/025* (2013.01); *F04C 29/026* (2013.01); *F04C 29/128* (2013.01)

(58) Field of Classification Search
USPC ..... 418/259, 266–268, 270, 75–76, 82, 93, 418/94 G
See application file for complete search history.

(56) References Cited

U.S. PATENT DOCUMENTS

| | | | | |
|---|---|---|---|---|
| 5,411,385 | A * | 5/1995 | Eto | F04C 29/02 418/96 |
| 7,150,610 | B2 * | 12/2006 | Takahashi | F01C 21/0872 418/268 |
| 8,956,132 | B2 * | 2/2015 | Satou | F01C 21/0872 418/DIG. 1 |
| 2002/0119054 | A1 | 8/2002 | Morita | |

FOREIGN PATENT DOCUMENTS

| | | | |
|---|---|---|---|
| JP | H04-0181591 | A | 3/1992 |
| JP | 2000-283080 | A | 10/2000 |
| JP | 2002-327692 | A | 11/2002 |
| JP | 2008-050963 | A | 3/2008 |

* cited by examiner

GAS COMPRESSOR FORMED WITH A HIGH-PRESSURE SUPPLY HOLE

CROSS REFERENCE TO RELATED APPLICATION

The present application is based on and claims priority from Japanese Patent Application No. 2014-43193, filed on Mar. 5, 2014 and No. 2014-235515, filed on Nov. 20, 2014, the disclosure of which is hereby incorporated by reference in its entirety.

BACKGROUND OF THE INVENTION

Field of the Invention

The present invention relates to a gas compressor of an air conditioning unit mounted in a vehicle, for example.

Description of the Related Art

A vehicle such as an automobile incorporates an air conditioning unit for controlling the temperature of a vehicle interior, for example. Such an air conditioning unit has a loop-like refrigerating cycle in which refrigerant as a cooling medium is circulated. The refrigerating cycle is comprised of an evaporator, a gas compressor, a condenser, and an expansion valve in order. A gas compressor is provided in the air conditioning unit to generate high-pressure refrigerant gas by compressing gaseous refrigerant evaporated through the evaporator and transmit it to the condenser.

In related art a vane type rotary gas compressor is known, which comprises a cylinder having an elliptical inner circumference in which a rotor with vanes is rotatably supported. The ends of the vanes are slidable on the inner circumference of the cylinder and the vanes are allowed to slide into and out of the rotor.

This vane type rotary gas compressor comprises a compressor body including a rotor rotatable integrally with a rotational shaft, a cylinder surrounding the outer circumference of the rotor, vanes allowed to slide from the outer circumference of the rotor to the inner circumference of the cylinder, and two side blocks sealing the respective ends of the rotor and cylinder and rotatably supporting both ends of the rotational shaft.

In the compressor body, two adjacent vanes in a rotor's rotational direction work to decrease the volume of compression chambers formed between the rotor outer circumference and cylinder inner circumference along with the rotation of the rotor. Thereby, low-pressure refrigerant gas in the compression chambers is compressed into high-pressure refrigerant gas and discharged to a discharge chamber. The high-pressure refrigerant gas is discharged outside from the discharge chamber after oil components such as refrigerant oil are separated. The separated oil is accumulated at the bottom of the discharge chamber.

The oil accumulated in the discharge chamber is pressed by the high-pressure refrigerant gas and supplied to vane grooves through the two side blocks and oil paths and chamfered grooves of the cylinder inside the side blocks, and it works as back pressure to protrude the ends of the vanes from the vane grooves. The oil supplied to the vane grooves is at intermediate pressure lower than the high-pressure ambience of the discharge chamber due to a pressure loss since it has passed through a small gap between a shaft bearing and the outer circumference of the rotational shaft.

However, in the last stage of compression process the pressure in the compression chambers goes higher than the intermediate pressure and this high pressure acts on the ends of the protruding vanes. If the back pressure onto the vanes remains at the intermediate pressure, the pressure in the compression chambers exceeds the intermediate back pressure and a centrifugal force from the vanes' rotation. This may cause chattering, that is, a phenomenon that the vanes' ends repeatedly collide with and separate away from the inner circumference of the cylinder.

In view of this, Japanese Laid-open Patent Application Publication No. 2002-327692 discloses a gas compressor in which oil at a higher pressure than the intermediate pressure is supplied through a high-pressure supply hole to the vane grooves when the inner pressure of the compression chambers is heightened in the last stage of the compression process.

In this gas compressor the high-pressure supply hole is formed in one of the side blocks to supply the oil accumulated at the bottom of the discharge chamber to the vane grooves by the pressure of the refrigerant gas discharged to the chamber. This can prevents chattering.

However, if an unnecessarily large amount of oil is supplied to the vane grooves through the high-pressure supply hole, the necessary oil amount accumulated in the discharge chamber is increased. The amount of oil contained in the gas compressor is increased accordingly, increasing the weight and costs of the compressor. Therefore, the diameter of the high-pressure supply hole needs to be formed small enough to prevent an excessive supply of oil.

However, the side blocks are made from aluminum alloy or the like, and forming a small diameter hole in a certain position of the side blocks by deep hole processing requires high processing technique, resulting in low workability and increased manufacturing costs.

SUMMARY OF THE INVENTION

The present invention aims to provide a gas compressor with a high-pressure supply hole which can be formed with good workability at a reduced processing cost.

According to one embodiment, a gas compressor comprises a compressor body comprising a rotor in a cylindrical shape to rotate integrally with a rotational shaft, having vane grooves, a cylinder with an inner circumference shaped to surround an outer circumference of the rotor, vanes plate-shaped, slidably inserted into the vane grooves, and abuttable at one ends on the inner circumference of the cylinder, upon receiving a back pressure from the vane grooves, two side blocks to enclose both ends of the rotor and the cylinder, respectively, compression chambers partitioned by the outer circumference of the rotor, the inner circumference of the cylinder, inner faces of the front and rear side blocks, and the vanes, and supplied with a medium to compress the medium to a high-pressure medium for discharge; an oil separator to separate, from the discharged high-pressure medium, oil to be used as the back pressure, an oil path through which the oil at a certain pressure is supplied to the vane grooves in a compression process of the medium in the compression chambers; and a high-pressure supply hole through which the oil at a pressure higher than the certain pressure is supplied to the vane grooves in a last stage of the compression process, the high-pressure supply hole formed in at least one of the side blocks by drilling, including a small diameter portion upstream of an oil flow direction and a large diameter portion downstream of the oil flow direction, larger in diameter than the small diameter portion, the small and large diameter portions being integrally formed along a length of the high-pressure supply hole.

BRIEF DESCRIPTION OF THE DRAWINGS

Features, embodiments, and advantages of the present invention will become apparent from the following detailed description with reference to the accompanying drawings.

DETAILED DESCRIPTION OF PREFERRED EMBODIMENT

Figure 1:
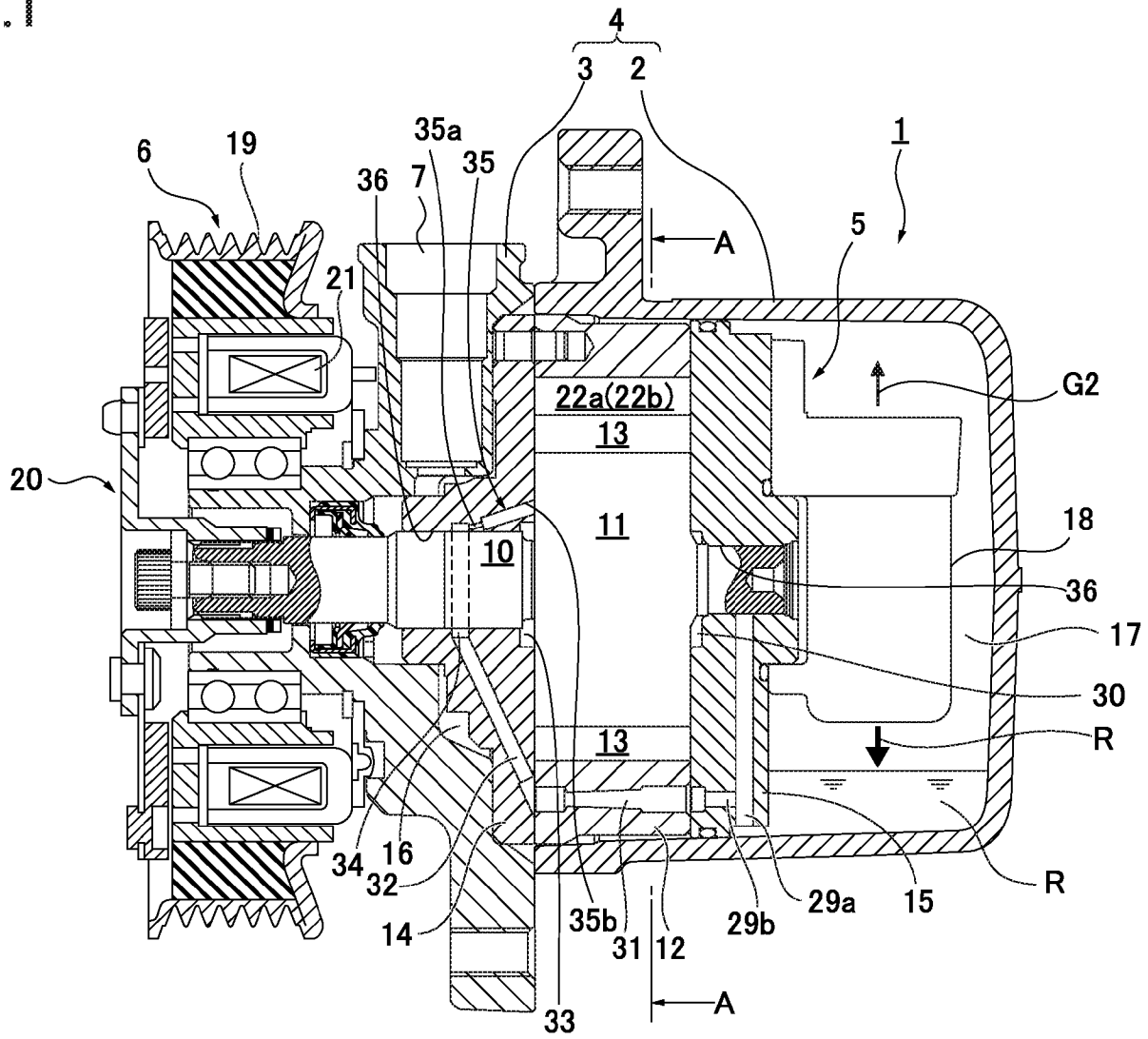
FIG. 1 is a schematic cross section view of a vane type rotary gas compressor according to one embodiment of the present invention.

Hereinafter, an embodiment of the present invention will be described in detail with reference to the accompanying drawings. Wherever possible, the same reference numbers will be used throughout the drawings to refer to the same or like parts. FIG. 1 is a schematic cross section view of a vane type rotary gas compressor (hereinafter, compressor) according to the present embodiment.

Overall Structure of Compressor

FIG. 1 shows a compressor 1 which is a part of an air conditioning system to use heat of vaporization of refrigerant. The compressor 1 is provided on a refrigerant circulation pathway together with a condenser, an expansion valve and an evaporator (not shown), for example. Such an air conditioning system is, for instance, an air conditioning unit for controlling the temperature of the interior of a vehicle such as automobile.

The compressor 1 draws refrigerant gas as a medium from the evaporator and compresses and supplies it to the condenser in the air conditioning system. The condenser liquefies the compressed refrigerant gas to a high-pressure liquid refrigerant and transmits it to the expansion valve. The expansion valve lowers the pressure of the liquid refrigerant and transmits it to the evaporator. The low-pressure liquid refrigerant absorbs heat from ambient air and vaporizes in the evaporator. Thereby, the air around the evaporator is cooled by heat exchange with the vaporization heat.

The compressor 1 comprises a cylindrical case 2 with an open end (left side in FIG. 1) and a closed end, a front head 3 enclosing the open end, a housing 4 comprising the case 2 and the front head 3, a compressor body 5 contained in the housing 4, and an electromagnetic clutch 6 to transmit a drive force from a not-shown engine of a vehicle to the compressor body 5.

The front head 3 is a cover element to seal the open end of the case 2 and secured around the open end with a bolt. It comprises an intake port 7 to draw low-pressure refrigerant gas from the not-shown evaporator of the air conditioning system. The case 2 is provided with a not-shown discharge port to discharge high-pressure refrigerant gas compressed in the compressor body 5 to a not-shown condenser.

Figure 2:
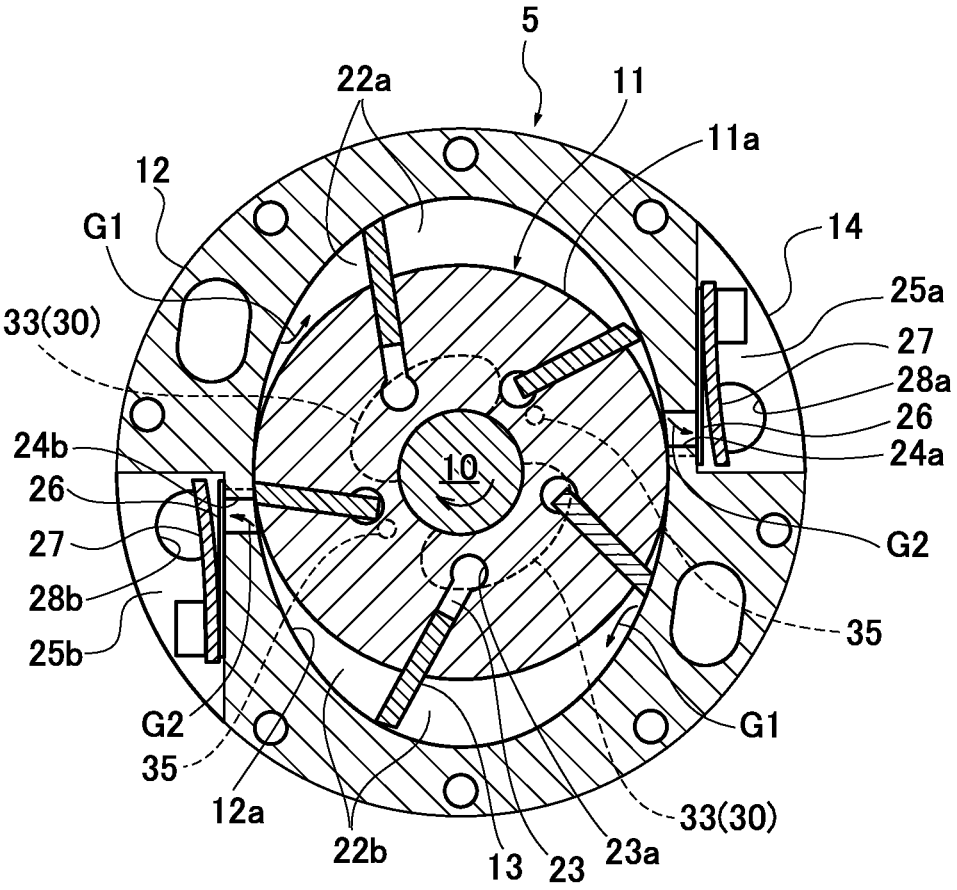
FIG. 2 is schematic cross section view of the gas compressor along the A to A line in FIG. 1.

FIG. 2 is a cross section view of the compressor 1 along the A to A line in FIG. 1. Note that FIG. 2 omits showing one side of the case 2 close to the outer circumference of the compressor body 5. As shown in FIG. 2, the compressor body 5 comprises a columnar rotor 11 integrally rotating with a rotational shaft 10, a cylinder 12 having an inner circumference 12*a* with an ellipsoidal cross section to enclose an outer circumference 11*a* of the rotor 11, two or more plate-like vanes (5 vanes in the drawing) allowed to protrude from the outer circumference 11*a* to the inner circumference 12*a* of the cylinder 12, and two side blocks, front side block 14 and rear side block 15 (in FIG. 1) fixed on both ends of the rotor 11 and cylinder 12 to enclose them.

A suction chamber 16 is provided between the front head 3 and front side block 14 while a discharge chamber 17 is provided near the rear side block 15 in the case 2. In the discharge chamber 17 an oil separator 18 is disposed on the outer surface of the rear side block 15. In FIG. 1 not a cross section but exterior of the oil separator 18 is shown.

The outer face of the front side block 14 is fixed on the inner circumference of the open end of the front head 3 with bolts. The outer circumference of the rear side block 15 is fitted into the inner circumference of the case 2. Thus, the front side block 14 of the compressor body 5 is fixed on the front head 3 with bolts and the rear side block 15 is fitted into the inner circumference of the housing 2.

The electromagnetic clutch 6 is mounted on the outer face of the front head 3 to transmit a rotational force of the engine to a pulley 19 via a not-shown belt. One end of the rotational shaft 10 (left side in FIG. 1) is fitted into a through hole of an armature 20 of the electromagnetic clutch 6. The rotational shaft 10 is rotatably supported in a through hole or shaft hole of the center of the front and rear side blocks 14 and 15.

During the operation of the compressor 1 (the compressor body 5), the armature 20 is absorbed onto the side face of the pulley 19 by excitation of an electromagnet 21 provided inside the pulley 19. Thereby, the engine's drive force is transmitted to the rotational shaft 10 of the rotor 11 from the pulley 19 via the armature 20.

Operation and Structure of Compressor Body 5

Two compression chambers 22*a*, 22*b* are formed by the five vanes 13 arranged with an equal interval in a space among the inner circumference 12*a* of the cylinder 12, the outer circumference 11*a* of the rotor 11, and both side blocks 14, 15 (FIG. 1), as shown in FIG. 2.

Each of the vanes 13 is slidable in each vane groove 23 and refrigerant oil is supplied to a bottom 23*a* of each vane groove 23. Each vane 13 protrudes outward from the outer circumference 11*a* of the rotor 11 by back pressure from the refrigerant oil. The compression chamber 22*a* is on the upper side of the space between inner circumference 12*a* of the cylinder 12 and the outer circumference 11*a* of the rotor 11 and the compression chamber 22*b* is on the lower side of the space.

Each of the compression chambers 22*a*, 22*b* repeatedly increases and decreases in volume in the refrigerant gas suction and compression processes along with the rotation of the rotor 11. The compressor 1 or compressor body 5 according to the present embodiment is configured to conduct the suction and compression twice per one rotation of the rotor 11.

The cylinder 12 further includes a not-shown intake hole to draw refrigerant gas G1 to the compression chambers 22*a*, 22*b* and discharge holes 24*a*, 24*b* to discharge refrigerant gas G2 compressed in the compression chambers 22*a*, 22*b*.

Specifically, while the volumes of the compression chambers 22*a*, 22*b* are increasing, the low-pressure refrigerant gas G1 is suctioned from the intake hole of the cylinder 12 into the compression chambers 22*a*, 22*b*. While their volumes are decreasing, the refrigerant gas is compressed to become high-temperature, high-pressure gas in the compression chambers 22*a*, 22*b*, This high-temperature and high-pressure refrigerant gas G2 is discharged through the discharge holes 24*a*, 24*b* to discharge chambers 25*a*, 25*b* partitioned by the cylinder 12, housing 2, and both side blocks 14, 15.

The discharge chambers 25*a*, 25*b* each include a valve 26 to prevent a reverse flow of the refrigerant gas to the compression chambers 22*a*, 22*b* and a valve support 27 to prevent the valve 26 from excessively deforming or distorting. The high-temperature, high-pressure refrigerant gas G2 in the discharge chambers 25*a*, 25*b* is introduced into the oil separator 18 in the discharge chamber 17 from discharge ports 28*a*, 28*b* of the rear side block 15.

The oil separator 18 works to separate refrigerant oil (such as oil leaking from the vane grooves 23 of the rotor 11 to the compression chambers 22*a*, 22*b*) from the refrigerant gas G2 by use of a centrifugal force. In detail the oil separator 18 is configured to swivel the introduced high-pressure refrigerant gas G2 spirally along the tubular inner circumference to thereby separate refrigerant from the refrigerant gas G2 by centrifugation.

The separated refrigerant oil R in FIG. 1 is then accumulated in the bottom of the discharge chamber 17 and the high-pressure refrigerant gas G2 after the oil separation is discharged to the outside condenser from the discharge port of the discharge chamber 17.

The accumulated refrigerant oil R in the discharge chamber 17 is supplied to the bottoms 23*a* of the vane grooves 23 by high-pressure ambience from the discharged refrigerant gas G2 through an oil path 29*a* and a chamfered groove 30 of the rear side block 15, to work as back pressure to move the vanes 13 outward. The chamfered groove 30 is a concave for supplying back pressure.

Also, the accumulated refrigerant oil R in the discharge chamber 17 is supplied to the bottoms 23*a* of the vane grooves 23 by high-pressure ambience from the discharged refrigerant gas G2 through the oil paths 29*a*, 29*b* of the rear side block 15, an oil path 31 of the cylinder 12 and an oil path 32 and a chamfered groove 33 of the front side block 14, to work as back pressure to move the vanes 13 outward. The chamfered groove 33 is a concave for supplying back pressure.

The refrigerant oil R supplied to the vane grooves 23 through the chamfered grooves 30, 33 loses pressure while passing through a narrow gap between the inner circumference 36 (FIG. 1) of the shaft hole of both side blocks 14, 15 and the outer circumference of the rotational shaft 10. The pressure of the oil is an intermediate pressure lower than the high-pressure ambience in the discharge chamber 17.

Figure 3:
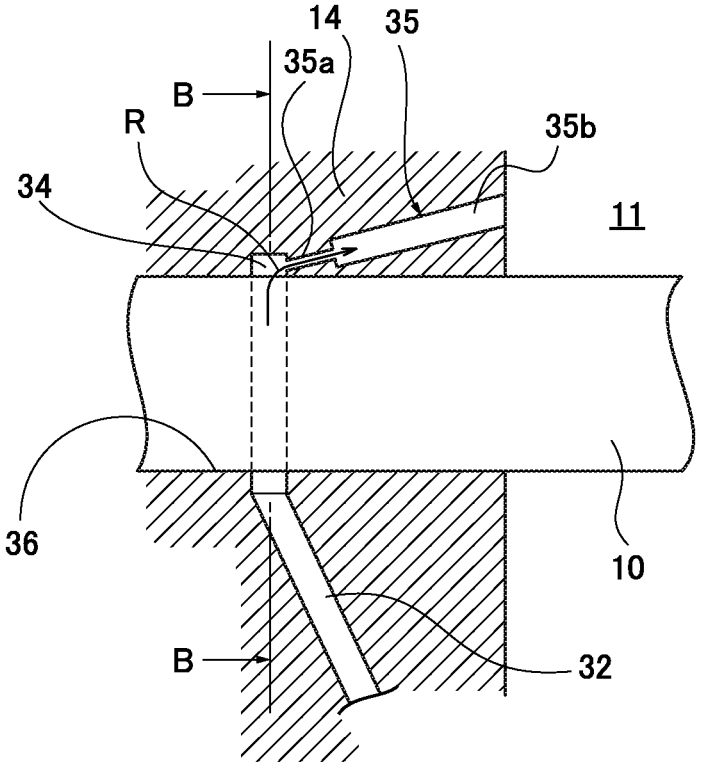
FIG. 3 is a schematic cross section view of a periphery of a high-pressure supply hole of a front side block.
Figure 4:
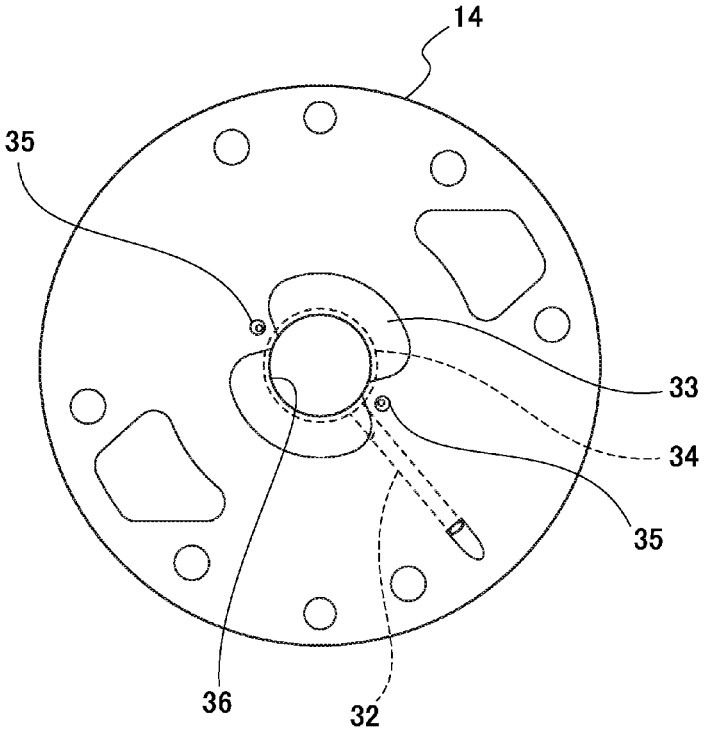
FIG. 4 shows the inner side of the front side block in FIG. 3.

For the purpose of supplying the refrigerant oil R at a higher pressure than the intermediate pressure to the bottoms 23*a* of the vane grooves 23, the compressor 1 of the present embodiment includes a ring-like oil groove 34 and a high-pressure supply hole 35 in communication with the oil path 32 in the front side block 14, as shown in FIGS. 1, 3 and 4.

Figure 5:
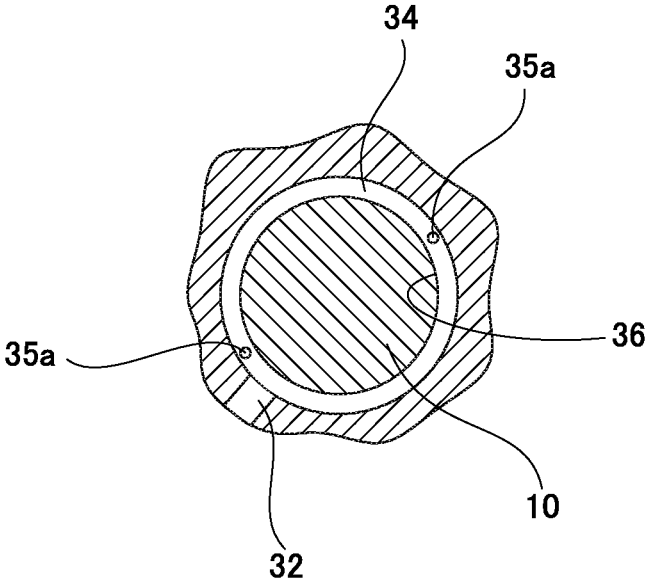
FIG. 5 is a cross section view of FIG. 3 along the B to B line.

FIG. 4 shows the inside (closer to the compressor body 5) of the front side block 14 and FIG. 5 is a cross section view of FIG. 3 along the B to B line. The ring-like oil groove 34 extends along the inner circumference 36 of the shaft hole into which the rotational shaft 10 is rotatably inserted, as shown in FIGS. 4 and 5. The high-pressure supply hole 36 is communicated with the oil groove 34 at one end and is open at the other end to the end of the rotor 11 in the front side block 14.

Figure 6:
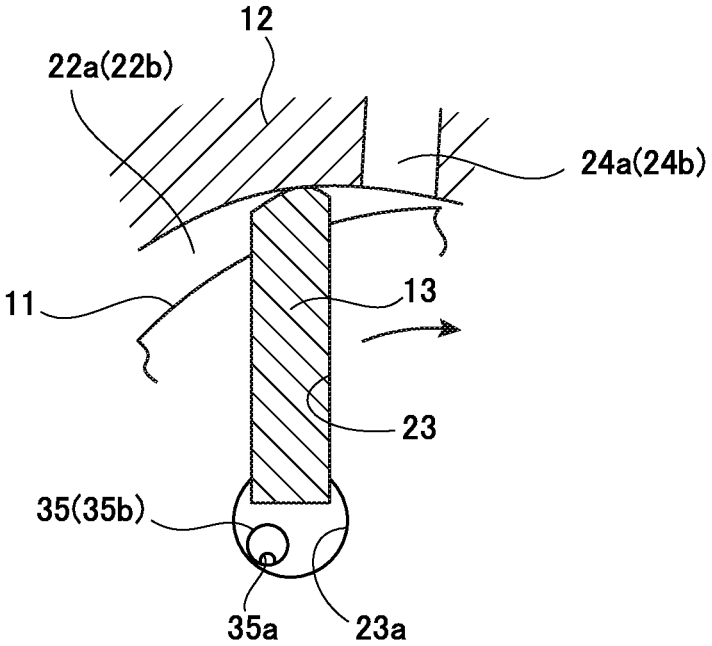
FIG. 6 is a schematic cross section view of the high-pressure supply hole in communication with a vane groove in the last stage of compression process.

Referring to FIG. 6, the high-pressure supply hole 35 is formed to be communicated with the bottoms 23*a* of the vane grooves 23 in the last stage of the compression process. Details of the high-pressure supply hole 35 will be described later.

The accumulated refrigerant oil R in the bottom of the discharge chamber 17 is supplied as back pressure to the bottoms 23*a* of the vane grooves 23 by high-pressure ambience from the discharged refrigerant gas G2 through the oil paths 29*a*, 29*b* of the rear side block 15, the oil path 31 of the cylinder 12 and the oil paths 32, 34 and the high-pressure supply hole 35 of the front side block 14.

Since a loss of this back pressure through the supply path is small, the back pressure is approximately equal to the high pressure of the refrigerant gas discharged to the discharge chamber 17. Because of this, chattering is prevented.

Now, the details of the high-pressure supply hole 35 of the front side block 14 are described.

Referring to FIG. 3, the high-pressure supply hole 35 is integrally and coaxially formed of a small diameter portion 35*a* and a large diameter portion 35*b*. The small diameter portion 35*a* is communicated with the oil groove 34. The large diameter portion 35*b* is open to one end of the front side block 14 on the rotor side. The small diameter portion 35*a* lies upstream of the flow of the refrigerant oil R and the large diameter portion 35*b* lies downstream thereof. As shown in FIGS. 3, 5, the upstream end of the small diameter portion 35*a* is open to the oil groove 34 and the radial width of the oil groove 34 is larger than the diameter of the small diameter portion 35*a*.

The diameter of the small diameter portion 35*a* is, for example, about 0.5 to 1.0 mm and almost the same size as that of a conventional high-pressure supply hole having a small uniform diameter. The diameter of the large diameter portion 35*b* is about 1.5 to 2.0 mm, for example and about twice or three times larger than that of the small diameter portion 35*a*. The length of the small diameter portion 35*a* is much shorter than that of the large diameter portion 35*b* and about ⅓ to ⅕ thereof.

To form the high-pressure supply hole 35 by boring, the front side block 14 is drilled from a rotor-side's end to form the large diameter portion 35*b* and further drilled with a different drill having a smaller diameter to form the small diameter portion 35*a*. Thereby, the integral coaxial high-pressure supply hole 35 in FIG. 3 is obtained.

Deep hole drilling of the large diameter portion 35*b* is easier than that of the small diameter portion. The small diameter portion 35*a* is short relative to the entire length of the high-pressure supply hole 35. Accordingly, it is possible to improve drilling workability of the small diameter portion 35*a* and reduce processing costs.

Moreover, the small diameter portion 35*a* provided upstream of the refrigerant oil flow functions as a restrictor to reduce the flow amount of the refrigerant oil R from the oil groove 34. The opening end of the large diameter portion 35*b* provided downstream of the small diameter portion 35*a* becomes communicated with the bottoms 23*a* of the vane grooves 23 in the last stage of the compression process to supply the refrigerant oil R thereto.

Thus, the amount of the refrigerant oil R is decreased by the small diameter portion 35*a* before flowing into the large diameter portion 35*b*. This can prevent an excessive supply of the refrigerant oil R to the bottoms 23*a* of the vane grooves 23. Accordingly, the oil amount contained in the compressor 1 can be reduced.

Further, according to the present embodiment the small diameter portion 35*a* lies upstream of the refrigerant oil flow and the upstream end thereof is open to the oil groove 34. Because of this, even if a foreign object such as removed chips and scraps or abrasion powder enters the refrigerant oil R in the oil groove 34 from the oil path 32, the foreign object is unlikely to enter the inside of the high-pressure supply hole 35 from the small diameter portion 35*a*, compared to the large diameter portion provided open to the oil groove 34. Accordingly, it is possible to avoid a trouble or failure such as a clogged small diameter portion with a foreign object.

Further, when the vanes 13 are slid on the cylinder's inner circumference and moved to recede, the pressure in the vane grooves 23 is going to be increased along with a decrease in the volumes thereof. However, since the large diameter portion 35*b* is provided close to the vane grooves 23, the volume of the large diameter portion 35*b* is added to that of the vane grooves, decreasing a change in the volumes and preventing the back pressure from becoming excessively large. Thus, the large diameter portion 35*b* functions as a damper.

The present embodiment has described an example where the high-pressure supply hole is formed in the front side block 14. Alternatively, the present invention is applicable to a structure that the high-pressure supply hole 35 is provided in the rear side block 15 or both of the front and rear side blocks 14, 15.

In related art the entire length of the high-pressure supply hole needs to be formed by deep hole drilling and it is not efficient in terms of workability. According to the present embodiment the small diameter portion 35*a* can be short relative to the entire length of the hole 35. Accordingly, it is possible to improve drilling workability of the small diameter portion 35*a* and reduce processing costs.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A gas compressor comprising:

a compressor body comprising a rotor in a cylindrical shape to rotate integrally with a rotational shaft, having vane grooves, a cylinder with an inner circumference shaped to surround an outer circumference of the rotor, vanes plate-shaped, slidably inserted into the vane grooves, and abuttable at one ends on the inner circumference of the cylinder, upon receiving a back pressure from the vane grooves, front and rear side blocks to enclose both ends of the rotor and the cylinder, respectively, compression chambers partitioned by the outer circumference of the rotor, the inner circumference of the cylinder, inner faces of the front and rear side blocks, and the vanes, and supplied with a medium, to compress the medium to a high-pressure medium for discharge;

an oil separator to separate, from the discharged high-pressure medium, oil to be used as the back pressure;

an oil path through which the oil at a certain pressure is supplied to the vane grooves in a compression process of the medium in the compression chambers; and a high-pressure supply hole through which the oil at a pressure higher than the certain pressure is supplied to the vane grooves in a last stage of the compression process, the high-pressure supply hole formed in at least one of the side blocks by drilling, including a small diameter portion upstream of an oil flow direction and a large diameter portion downstream of the oil flow direction, larger in diameter than the small diameter portion, the small and large diameter portions being integrally formed along a length of the high-pressure supply hole; wherein the small diameter portion and the large diameter portion are integrally and coaxially formed; and wherein the at least one of the side blocks includes a shaft hole into which the rotational shaft is rotatably inserted and having an oil groove of a ring shape on an inner surface of the shaft hole, extending in a circumferential direction, to be supplied with the oil at a higher pressure than the certain pressure; and an upstream end of the small diameter portion is open to the oil groove.

2. A gas compressor comprising:

a compressor body comprising a rotor in a cylindrical shape to rotate integrally with a rotational shaft, having vane grooves, a cylinder with an inner circumference shaped to surround an outer circumference of the rotor, vanes plate-shaped, slidably inserted into the vane grooves, and abuttable at one end on the inner circumference of the cylinder, upon receiving a back pressure from the vane grooves, front and rear side blocks to enclose both ends of the rotor and the cylinder, respectively, compression chambers partitioned by the outer circumference of the rotor, the inner circumference of the cylinder, inner faces of the front and rear side blocks, and the vanes, and supplied with a medium, to compress the medium to a high-pressure medium for discharge;

an oil separator to separate, from the discharged high-pressure medium, oil to be used as the back pressure;

an oil path through which the oil at a certain pressure is supplied to the vane grooves in a compression process of the medium in the compression chambers; and a high-pressure supply hole through which the oil at a pressure higher than the certain pressure is supplied to the vane grooves in a last stage of the compression process, the high-pressure supply hole formed in at least one of the side blocks by drilling, including a small diameter portion upstream of an oil flow direction and a large diameter portion downstream of the oil flow direction, larger in diameter than the small diameter portion, the small and large diameter portions being integrally formed along a length of the high-pressure supply hole; wherein the small diameter portion and the large diameter portion are integrally and coaxially formed.

* * * * *